US007264066B2

(12) United States Patent
Glas et al.

(10) Patent No.: US 7,264,066 B2
(45) Date of Patent: Sep. 4, 2007

(54) DRILLING APPARATUS AND METHOD FOR INTRODUCING A DRILLING ELEMENT INTO THE SOIL

(75) Inventors: Nikolaus Glas, Hilgertshausen (DE); Peter Josef Unglert, Neuburg (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 313 days.

(21) Appl. No.: 11/002,898

(22) Filed: Dec. 3, 2004

(65) Prior Publication Data

US 2005/0133264 A1 Jun. 23, 2005

(30) Foreign Application Priority Data

Dec. 23, 2003 (DE) ..... 103 60 912

(51) Int. Cl.
*E21B 19/08* (2006.01)

(52) U.S. Cl. ..... 175/51; 175/162

(58) Field of Classification Search ..... None
See application file for complete search history.

(56) References Cited

U.S. PATENT DOCUMENTS 3,994,350 A * 11/1976 Smith et al. ..... 175/85
4,753,300 A * 6/1988 Shaw et al. ..... 173/164
4,765,401 A * 8/1988 Boyadjieff ..... 186/77.53
5,215,153 A 6/1993 Younes

FOREIGN PATENT DOCUMENTS

| | | |
|---|---|---|
| DE | 497215 C | 4/1930 |
| DE | 12 15 624 | 5/1965 |
| DE | 38 09 626 | 3/1988 |
| GB | 1 558 455 A | 1/1980 |

* cited by examiner

*Primary Examiner*—Frank Tsay
(74) *Attorney, Agent, or Firm*—Jacobson Holman PLLC

(57) ABSTRACT

The invention relates to a drilling apparatus and a method for introducing a drilling element into the soil comprising a drive, which is supported on a mast for introducing the drilling element, and a collet turning device having a collet which can be turned by means of at least one operating cylinder. In order to improve the torque transmission at least two collet turning devices are provided which can be engaged with the drilling element so as to transmit the torque.

16 Claims, 3 Drawing Sheets

DRILLING APPARATUS AND METHOD FOR INTRODUCING A DRILLING ELEMENT INTO THE SOIL

Figure 1:
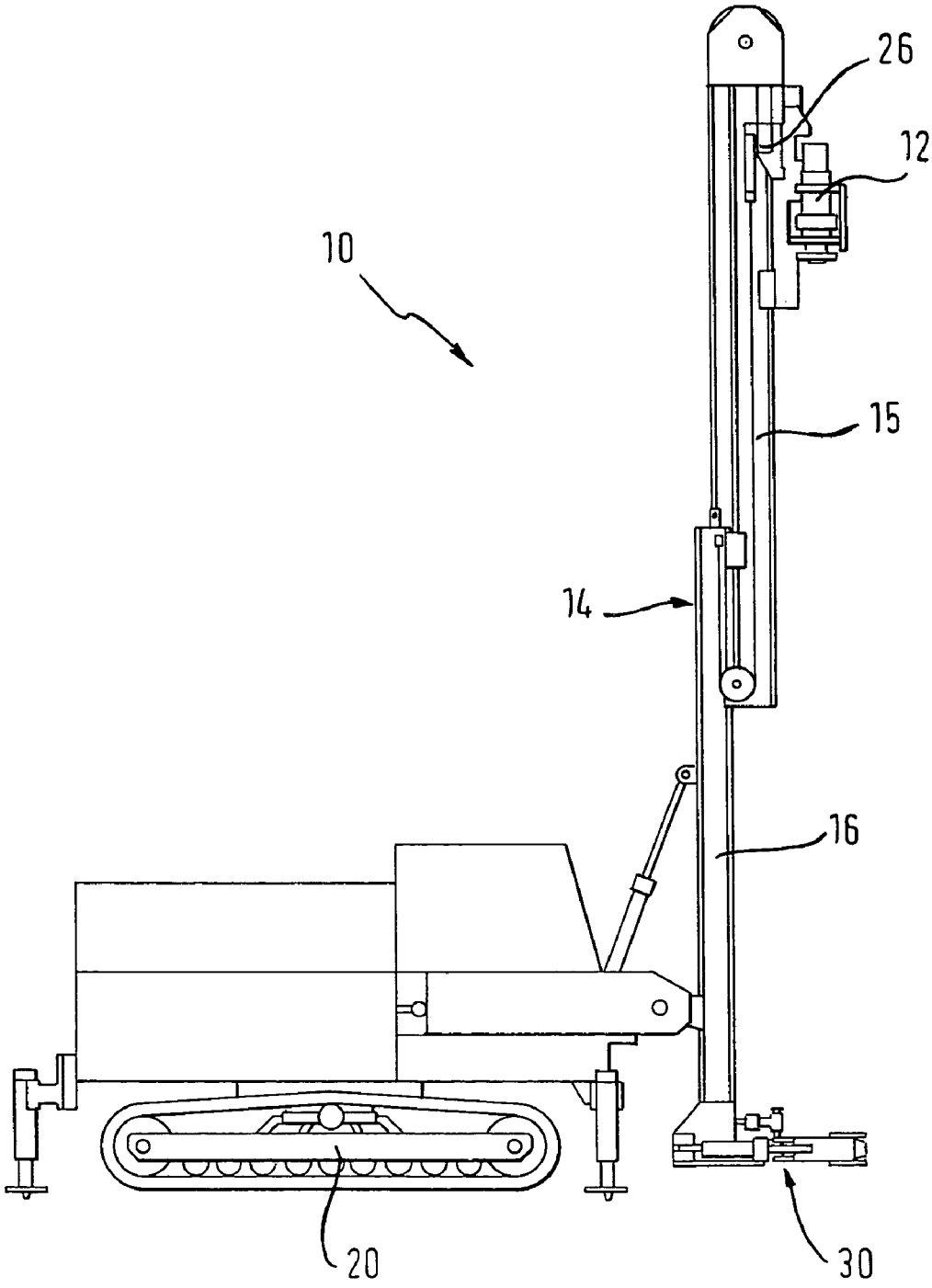

The invention relates to a drilling apparatus for introducing a drilling element into the soil comprising a drive, which is supported on a mast for introducing the drilling element, and a collet turning device having a collet which can be turned by means of at least one operating cylinder. The invention further relates to a method for introducing a drilling element into the soil, with a torque being applied to the drilling element by means of a collet turning device.

In the prior art a variety of soil drilling machines is known which are employed especially in special foundation engineering for foundation-laying measures. With these soil drilling machines a drill hole can either be produced by means of a drilling tool, with the hole being then filled e.g. with concrete in order to produce a foundation pile. Furthermore, with a drilling apparatus a screw anchor or a boring pile having a screw tip can also be screwed directly into the soil. Especially in the latter case relatively high drilling torques may be required for great pile lengths in order to screw the pile into the soil.

The drilling drive is to be designed according to the maximum torque to be expected, for which reason the drive constitutes a major cost factor in a drilling apparatus.

Furthermore, to make cased drillings drilling apparatuses are known which are additionally provided with a so-called casing machine. This serves to screw in supporting casings. Such casing machines have a collet which can be turned through operating cylinders.

A movable drilling apparatus with attached casing machine is disclosed in DE 38 09 626 C2. The casing machine includes a supporting table that can be lifted and lowered by hydraulic cylinders. A bearing ring rotatably supported in the supporting table is turned back and forth by two hydraulic cylinders retained on the supporting table. On one upper side the bearing ring carries two clamping jaws which can be moved towards each other and can be opened and closed by a hydraulic cylinder. Through the clamping jaws the end of the pipe string is clamped and introduced into the soil or withdrawn therefrom as a result of the rotation of the bearing ring.

In DE 12 15 624 B a further device for drilling a casing into a deep drilled borehole is disclosed. In the device described therein the casing is moved downwards prior to the moment of the respective directional change of a cyclically alternating rotary movement. The cyclically alternating rotary movement is effected by means of a casing clamp fixed to the drill pipe, whose both arms are moved back and forth alternatingly by press cylinders. The frame for the casing clamp and the press cylinder is displaced in the vertical direction by means of a pressure cylinder.

The invention is based on the object to provide a drilling apparatus, with which also drilling operations requiring a particularly great amount of power can be carried out efficiently with a low-cost construction. Furthermore, it is the object of the invention to provide an efficient method for introducing a drilling element into the soil.

The device-related part of the object is solved in accordance with the invention by a drilling apparatus having the features of claim 1. The method-related part of the object is solved in accordance with the invention by a method having the features of claim 8. Preferred embodiments of the invention are stated in the respective subclaims.

The drilling apparatus according to the invention is characterized in that at least two collet turning devices are provided which can be engaged with the drilling element for the torque transmission. A basic idea of the invention resides in the fact that a torque is applied to the drilling element in addition to a rotary drive provided, which is usually constituted by a hydraulic motor, or that it is applied exclusively by two collet turning devices. Thus, at least at specific points in time an additional torque support can be applied to the drilling element beside the normal rotary drive. The drilling element can be a drilling tool, which is extracted again from the drill hole after its introduction, a supporting casing that is to be introduced or a screw pile or anchor element which directly serves as foundation element and remains in the soil.

The use of a collet with an operating cylinder to turn the collet permits the generation of a very high torque for a limited turning angle. As experience has shown that during drilling the maximum drilling torque is not required during the entire drilling time but only for a peak load at very limited points of time, the drive of the drilling apparatus can be laid out in a cost-effective manner for the normal drilling torque. To bridge the torque peak the collet turning devices can be employed.

In this connection it is intended according to the invention that for the torque transmission the collet turning devices can be engaged with the drilling element simultaneously and/or chronologically offset to each other. As a result of a defined chronologically offset operation of the at least two collet turning devices it is possible to adjust a more uniform torque support and in some cases even a quasi-continuous drilling operation despite a limited turning angle of the collet turning devices. In the case of specific extremely high torque peaks it is in principle also possible for the several collet turning devices to be operated simultaneously so that the maximum torque is multiplied accordingly.

To achieve a desired synchronisation of the collet turning devices it is intended according to the invention that a coupling is provided by means of which the movements of the collet turning devices can be coordinated. The coupling can be constituted by a mechanical coupling which, whilst moving one collet turning device in the drilling direction during the torque support, simultaneously effects a resetting of the second collet turning device to its starting position when this is located in the corresponding free-running position. Accordingly, the second collet can then clamp the drilling element and apply a torque to the drilling element whilst this is being driven into the soil, whereas alternatively the first collet turning device is reset by the coupling, in particular by a coupling rod. Apart from this purely mechanical coupling an electronic, control-operated coupling can also be provided. To move the individual collet turning devices with the drilling element separate operating devices are provided, e.g. hydraulic operating cylinders, which are controlled by a central control according to a predetermined programme for a desired synchronisation. The coupling rod itself can also be designed as an operating cylinder, in particular as a hydraulic cylinder.

According to the invention it is preferred that the collet turning devices are fixed to the lower end portion of the mast. This permits a torque support even when the drilling element is almost completely inserted into the soil.

An efficient drilling operation is achieved in accordance with the invention in that the collet turning devices are pivotally and/or movably supported in the drilling direction. As a result, the torque support can act on the drilling element even during a feed motion of the latter.

Another embodiment of the invention is characterized in that the collet has two clamping jaws which are adjustable by means of a clamping cylinder between a clamping position and a free-running position. An adjustable collet permits a clamping of the drilling element along the entire length and can also compensate differences in diameter of the drilling element. The clamping jaws are adaptable to the respective drilling element so that a good transmission of force is ensured in the clamping position and an adequate distance to the drilling element is maintained in the free-running position. The clamping cylinder and the operating cylinders of the collet turning device are preferably designed as hydraulic cylinders which are able to generate particularly high forces.

Finally, it is intended according to the invention that a control device is provided, through which a rotary drive, a feed drive and the collet turning devices can be operated in a coordinated manner. The control device can thereby coordinate a continuous rotary drive, in particular a hydraulic motor, with the discontinuous collet turning devices.

The method in accordance with the invention is characterized in that at least two collet turning devices are provided through which a torque is applied to the drilling element. With a relatively simple construction of the drilling apparatus it is possible to apply in a simple manner relatively high torques to the drilling element by means of these collet turning devices.

In this connection it is intended in accordance with the invention that the collet turning devices transmit a torque to the drilling element simultaneously and/or chronologically offset to each other. Thus, with the collet turning devices either a particularly high maximum torque or a more uniform torque support or even a quasi-continuous drilling operation can be reached.

Another preferred embodiment of the invention resides in the fact that during the torque transmission the collet turning devices are moved at least partly with the drilling element in drilling direction until said collet turning devices are reset to their starting position, and in that one of the collet turning devices is moved together with the drilling element while another collet turning device is reset to its starting position. As a result of such an offset mode of operation of the individual collet turning devices it is possible to adjust an improved torque support in spite of a limited turning angle. Depending on the turning angle of the collet turning devices and their numbers which may also amount to more than two, a quasi-continuous turning operation can even be achieved thereby.

To coordinate or synchronize the discontinuous and continuous drives it is intended according to the invention for the rotation of a rotary drive, the feed motion of the drilling element and the operation of the collet turning devices to be controlled in a coordinated manner. This can be implemented by means of a central control device, which is usually constituted by a computer.

Furthermore, it is intended in accordance with the invention that the torque support is effected at specific periods of time only, in particular during a final drilling phase. When a drilling element is drilled into the soil the torque load increases upon an increasing drilling depth and the higher friction surface. Therefore the torque support is preferably effected in the final phase so that a reliable turning motion is ensured at this point of time, too.

Basically, the drilling element can be constituted by a drilling tool that can be removed from the drill hole again, such as a drilling screw or any other continuously or discontinuously operating drilling tool or a supporting casing. However, it is preferred according to the invention that a screw pile, in particular with conical screw tip, is used as drilling element. Especially during the drilling-in of such foundation piles by means of screw flights high torques usually have to be applied, since a considerable part of the soil is being displaced whereby a high surface friction is generated.

Another embodiment of the invention resides in the fact that as foundation-laying measures the screw pile is driven through loose soil layers up to a solid soil layer, with the torque support being effected for the introduction into the solid soil layer. Thus, by means of the rotary drive screw piles can be screwed through the loose soil and anchored efficiently in solid soil layers with the support of the casing device.

Figure 2:
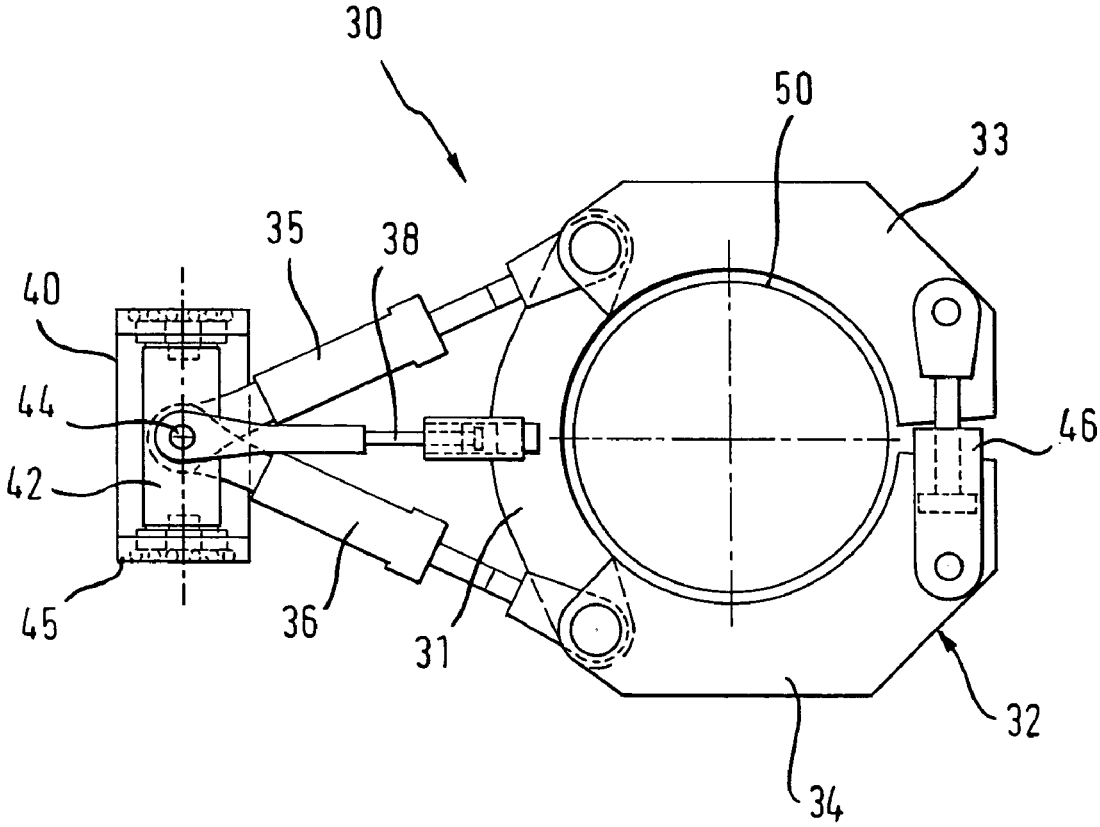
Figure 3:
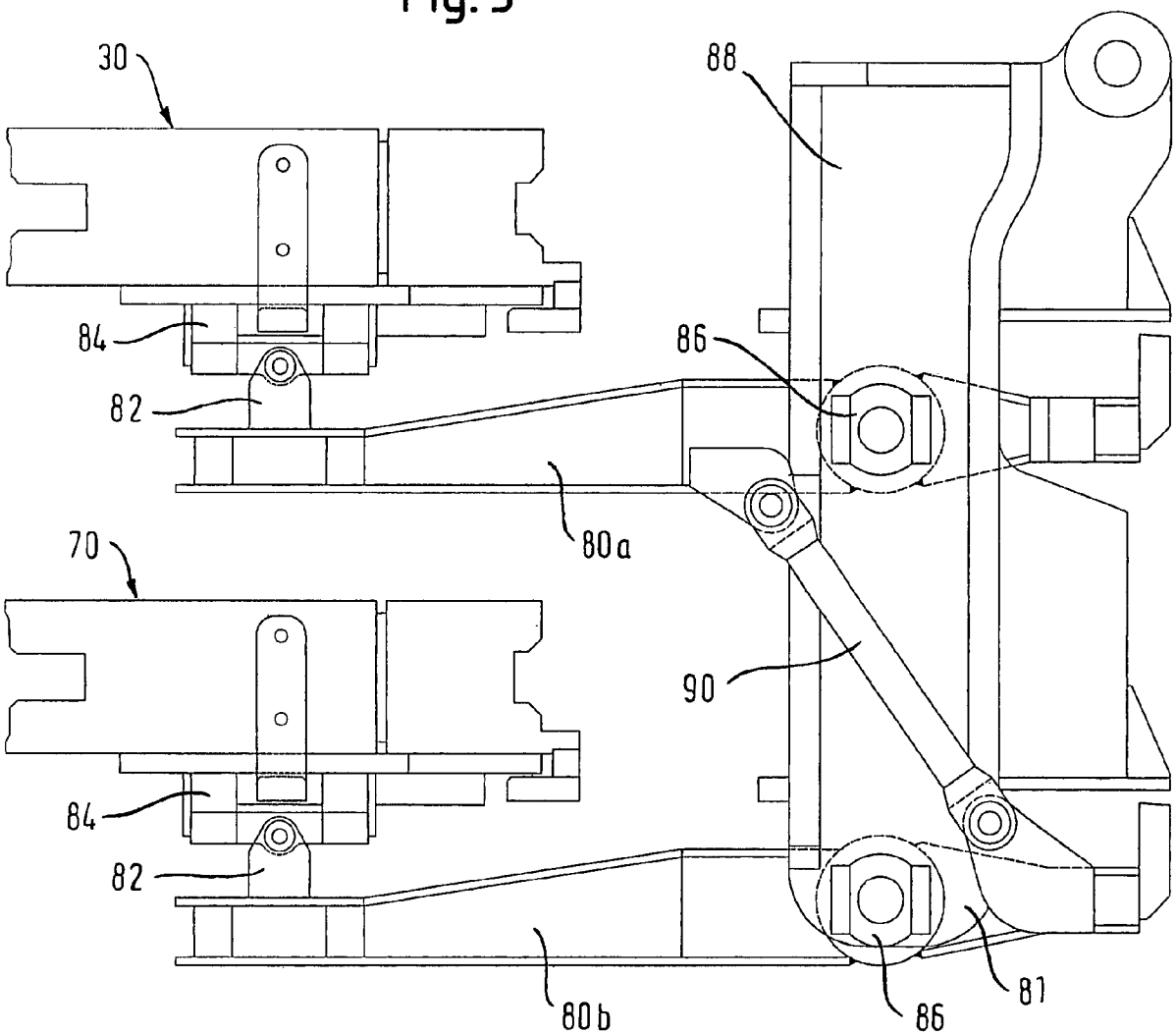

In the following the invention will be described by way of preferred embodiments which are schematically shown in the accompanying drawings. The drawings show:

FIG. 1 a side view of a drilling apparatus comprising a collet turning device;

FIG. 2 a top view of a collet turning device according to the invention; and FIG. 3 a side view of an arrangement of two collet turning devices with a mechanic coupling.

The drilling apparatus 10 shown in FIG. 1 has a carriage 20 designed as a crawler, to which a mast 14 is pivotally hinged between a horizontal transport position and a depicted vertical operating position. The mast 14, which can be pivoted in a known manner by hydraulic cylinders, is designed as a so-called leader with a stationary basic mast 16 on which a movable mast 15 comprising a moving device is slidably supported.

On the movable mast 15 a rotary drive 12 is slidably supported through a feed drive 26, which rotary drive serves to drive a drilling element not depicted here. At the lower end of the mast 14 the collet turning devices are arranged, with only one turning device 30 being depicted in the illustration of FIG. 1 for reasons of greater clarity.

In FIG. 2 the basic construction of a turning device 30 with a collet 32 is shown which encloses a drilling element 50. The collet 32 illustrated in FIG. 2 is in the free-running position in which the collet 32 is spaced all-round from the enclosed drilling element 50 so that the drilling element 50 can be moved freely through the collet 32 in the drilling direction that extends perpendicularly to the plane of the drawing.

The collet 32 comprises an arc-shaped collet base 31, at both ends of which a clamping jaw 33, 34 is each pivotally hinged. The free ends of both clamping jaws 33, 34 lie opposite each other and are connected by means of a clamping cylinder 46. By retracting the clamping cylinder 46 the clamping jaws 33, 34 can be moved towards each other, whereby a force-locking connection can be established with the drilling element 50.

The collet base 31 is fixed to the mast 14 via a length-adjustable supporting arm 38 by means of a supporting bearing 40. For a Cardanic suspension the supporting bearing 40 has a horizontal pivot pin 42 that is rotatably supported on a bearing block 45. On the horizontal pivot pin 42 a vertically directed vertical pivot pin 44 is provided, on which the mast-facing end of the supporting arm 38 and the mast-facing ends of two operating cylinders 35, 36 are pivotally supported. The operating cylinders 35, 36 serve to turn the collet 32 with respect to the supporting bearing 40, with the collet-facing ends of the operating cylinders 35, 36 being each pivotally supported on the collet base 31 in those points in which the clamping jaws 33, 34 are also supported on the collet base 31.

The supporting bearing 40 renders it possible for the collet 32 to be able to follow the clamped drilling element when this is moved in the drilling direction. When a feed motion of the drilling element 50 takes place during a drilling operation, the collet 32, being in the clamping position, directs with its operating cylinders 35, 36 the motion of the drilling element 50 towards the ground. Following an opening of the clamping cylinder 46, the collet 32 is reset upwards through a renewed turning operation.

In the schematic view of FIG. 3 a first collet turning device 30 and a second collet turning device 70 are arranged on top of each other in the drilling direction, which are illustrated in part only. The basic construction of both collet turning devices 30, 70 corresponds to the explanations given above with respect to FIG. 2 with the exception of the linkage to the mast.

Both collet turning devices 30, 70 are each mounted on a rocker 84 which is pivotally supported about a horizontal axis on a bearing block 82 that is in turn fixed to a beam-shaped carrier 80*a* or 80*b*. In the idle position shown in FIG. 3 both beam-shaped carriers 80*a*, 80*b* are directed horizontally and are movably supported on a base frame 88 by means of a respective horizontal pivot bearing 86. The base frame 88 can be fixedly connected to the mast of the drilling apparatus.

For the mechanical coordination or synchronisation of the movements of both collet turning devices 30, 70 a coupling rod 90 is provided which is hinged on the one hand to the upper carrier 80*a* between the horizontal pivot bearing 86 and the bearing block 82. On the other hand the coupling rod 90 is hinged to a lever arm 81 of the lower carrier 80*b*. The lever arm 81 is designed in a rigid manner on the beam-shaped carrier 80*b* but extends in a direction opposed to the carrier 80*b* by facing away from the horizontal pivot bearing 86.

On account of the diagonal linkage with the coupling rod 90 it is effected that during a downward pivoting of the upper carrier 80*a* the lower carrier 80*b* is pivoted upwards at the same time. Alternatively, the lower carrier 80*b* is pivoted downwards again and at the same time an upward resetting of the upper carrier 80*a* takes place. As a result of this coordination of the pivot motions of both collet turning devices 30, 70 a more uniform torque support can be implemented. Thus, during the torque support effected by a collet turning device 30, in which the collet turning device 30 that is in its clamping position is pivoted with the drilling element in the drilling direction, the other collet turning device 70, being in its free-running position, is pivoted back to its upward starting position. The clamping position of both collet turning devices 30, 70 can then be changed so that the feed motion of the drilling element moves the then clamped second collet turning device 70 downwards, while the upper first collet turning device 30 that is in its free-running position is at the same time reset to its starting position.

The invention claimed is:

1. A drilling apparatus for introducing a drilling element into the soil, the drilling apparatus comprising:

a mast, a rotary drive, supported on the mast for introducing the drilling element into the soil by means of a torque, and at least two collet turning devices wherein each turning device has a collet that can be turned by means of at least one operating cylinder, and wherein the at least two collet turning devices can be engaged with the drilling element driven by the rotary drive in order to support the torque to the drilling element.

2. Drilling apparatus according to claim 1, wherein for the torque support the at least two collet turning devices can be engaged with the drilling element simultaneously and/or chronologically offset to each other.

3. Drilling apparatus according to claim 1, wherein a coupling is provided by means of which movements of the at least two collet turning devices can be coordinated.

4. Drilling apparatus according to claim 1, wherein the at least two collet turning devices are fixed to the lower end portion of the mast.

5. Drilling apparatus according to claim 1, wherein the at least two collet turning devices are pivotally and/or movably supported in the drilling direction.

6. Drilling apparatus according to claim 1, wherein the collet has two clamping jaws, which are adjustable by means of a clamping cylinder between a clamping position and a free-running position.

7. Drilling apparatus according to claim 1, further comprising a control device, through which a rotary drive, a feed drive and the collet turning devices are operated in a coordinated manner.

8. Method for introducing a drilling element into the soil, in particular by means of a drilling apparatus according to claim 1, the method comprising the steps of:

applying a torque to the drilling element by means of at least one of the collet turning devices, and wherein at least two collet turning devices are provided, through which a torque is transmitted chronologically offset to each other to the drilling element.

9. Method according to claim 8, wherein during the torque transmission the collet turning devices are moved at least partly with the drilling element into the drilling direction until they are reset to their starting position, and wherein one of the collet turning devices is moved with the drilling element while another collet turning device is reset to its starting position.

10. Method according to claim 8, wherein the rotation of a rotary drive, the feed motion of the drilling element and the operation of the collet turning devices are controlled in a coordinated manner.

11. Method according to claim 8, wherein the torque support is effected at specific periods of time.

12. Method according to claim 8, wherein a screw pile, is used as the drilling element.

13. Method according to claim 12, wherein as foundation-laying measures the screw pile is driven through loose soil layers up to a solid soil layer, with the torque support being effected for the introduction into the solid soil layer.

14. Method according to claim 11, wherein the torque support is effected during a final drilling phase.

15. Method according to claim 12, wherein the screw pile has a conical screw tip.

16. A drilling apparatus for introducing a drilling element into the soil, the drilling apparatus comprising:

a mast, a rotary drive supported on the mast for introducing the drilling element into the soil, and at least two collet turning devices wherein each turning device has a collet that has two clamping jaws, which are adjustable by means of a clamping cylinder between a clamping position and a free-running position so that the collet can be turned, and wherein the at least two collet turning devices can be engaged with the drilling element driven by the rotary drive in order to support the torque.

* * * * *